United States Patent [19]

Sietmann et al.

[11] 4,426,937

[45] Jan. 24, 1984

[54] HEAT EXCHANGER FURNACE

[76] Inventors: Vernon H. Sietmann, Laurel, Iowa 50141; Steven C. Stockdale; Elmer G. Stockdale, both of Rte. #3, Iowa Falls, Iowa 50126

[21] Appl. No.: 310,478

[22] Filed: Oct. 13, 1981

Related U.S. Application Data

[62] Division of Ser. No. 176,409, Aug. 8, 1980, Pat. No. 4,319,557.

[51] Int. Cl.[3] ..... F23K 3/10; F24H 3/00

[52] U.S. Cl. ..... 110/288; 110/322; 126/99 D; 126/77; 126/112

[58] Field of Search ..... 110/288, 322, 276, 297, 110/313; 126/99 D, 112, 77; 165/DIG. 2; 237/55

[56] References Cited

U.S. PATENT DOCUMENTS

| | | | |
|---|---|---|---|
| 776,568 | 12/1904 | Voorhis | 126/69 |
| 1,668,125 | 5/1928 | Regan | 126/99 D |
| 1,929,889 | 10/1933 | Heaton | 110/270 |
| 2,141,764 | 12/1938 | Riddell | 110/288 |
| 2,160,264 | 5/1939 | Furlong | 126/99 D |
| 2,177,573 | 10/1939 | Kormendi | 126/83 |
| 2,190,343 | 2/1940 | Town | 126/75 |
| 2,218,895 | 10/1940 | Selig | 110/288 |
| 2,250,181 | 7/1941 | Crocker | 110/288 |
| 2,359,445 | 10/1944 | Schweickart | 110/288 |
| 2,364,698 | 12/1944 | Davin | 110/322 |
| 2,365,679 | 12/1944 | Casey | 110/288 |
| 2,376,170 | 5/1945 | Mueller | 237/55 |
| 2,378,376 | 6/1945 | Ackron | 110/288 |
| 2,387,781 | 10/1945 | Suman | 110/288 |
| 2,400,900 | 5/1946 | Agricola | 126/77 |
| 2,524,087 | 10/1950 | Serafini | 110/288 |
| 2,855,919 | 10/1958 | Prim | 110/322 |
| 3,311,074 | 3/1967 | Margetts | 110/288 |
| 4,059,090 | 11/1977 | Shaw | 126/121 |
| 4,147,303 | 4/1979 | Talucci | 126/99 D |
| 4,150,658 | 4/1979 | Woods | 126/121 |
| 4,173,966 | 11/1979 | Scharen | 126/121 |
| 4,202,318 | 5/1980 | DePodesta et al. | 126/110 R |

*Primary Examiner*—Daniel J. O'Conner
*Attorney, Agent, or Firm*—Zarley, McKee, Thomte, Voorhees & Sease

[57] ABSTRACT

A heat exchanger furnace includes a firebox, a heat exchanger housing in communication with the firebox for receiving combustion gases therefrom, and a plenum housing surrounding the heat exchanger housing so as to define a plenum chamber therebetween. A plurality of baffles are supported in vertically spaced apart relation within the heat exchanger housing, which baffles include peripheral edges disposed in clearance relation from the housing sidewalls whereby hot combustion gases rising within the heat exchanger housing are directed outwardly adjacent the heat exchanger sidewall for increased heat transfer to the plenum chamber. Exhaust tubes at the top of the heat exchanger housing may be directed through the plenum chamber for providing additional heat transfer surfaces therein. The firebox may have a frusto conical shaped sidewall whereby the combustion surface area may be adjusted with the level of fuel in the firebox. A forced air supply to the firebox may include a transfer tube in communication with the fuel inlet passage to prevent the escape of combustion gases from the firebox through the fuel inlet passage.

1 Claim, 2 Drawing Figures

HEAT EXCHANGER FURNACE

This is a divisional application of co-pending application Ser. No. 176,409, filed Aug. 8, 1980, now U.S. Pat. No. 4,319,557.

BACKGROUND OF THE INVENTION

The present invention relates generally to heat exchanger furnaces and more particularly to an improved heat exchanger furnace including features which improve its operating efficiency.

Heat exchanger furnaces have previously been constructed wherein a generally cylindrical heat exchanger housing is surrounded by a larger plenum housing to define a plenum chamber between them. Heat transfer occurred almost exclusively by conduction of heat from the heat exchanger housing sidewall to air passing through the plenum chamber. Hot combustion gases were simply vented directly to the atmosphere from the heat exchanger housing thereby wasting considerable energy. Furthermore, it was difficult to control the combustion within the fireboxes of some units with the result that only partially burned fuel had to be removed from the firebox and wasted. Finally, some heat exchanger furnaces have the problem of smoke escaping from the firebox through the fuel supply passage whereby the stored fuel may take on a burnt odor and become less suitable for combustion. These and other problems are believed to be resolved by the heat exchanger furnace of the present invention.

SUMMARY OF THE INVENTION

The heat exchanger furnace of the present invention includes a plurality of baffles arranged in vertically spaced relation within the heat exchanger housing for directing the rising combustion gases outwardly against the housing sidewalls for increased convective heat transfer to the housing sidewalls and ultimately to the plenum chamber. Exhaust gases from the heat exchanger housing are conveyed to the atmosphere through exhaust tubes which are directed downwardly through the plenum chamber for presenting increased heat transfer surfaces to the air therein. Uniform distribution of airflow through the plenum chamber is assured by a baffle disposed adjacent to and upstream of a forced air inlet at the base of the plenum chamber. The frusto conical shaped firebox enables the combustion surface area of fuel to be adjusted in accordance with the level of fuel in the firebox. The forced air supplied to the firebox and restricted opening therefrom contributes to increased temperatures within the firebox which assures substantially complete combustion of all fuel. A simple transfer tube which communicates at one end with the forced air supply and at the other end with the fuel supply prevents the escape of smoke or combustion gases from the firebox to the fuel supply. These and other advantages of the present invention will be apparent from the following description and patent drawings.

DESCRIPTION OF THE PREFERRED EMBODIMENT

Figure 1:
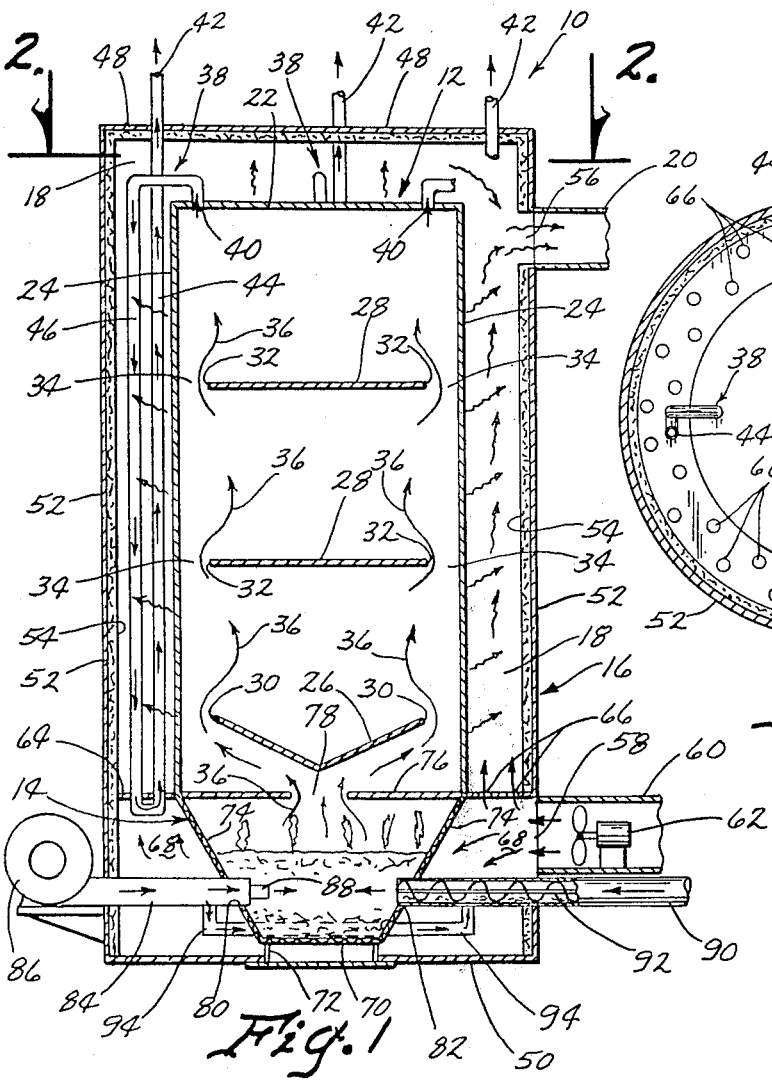
FIG. 1 is a side sectional view of the heat exchanger furnace of the invention.
Figure 2:
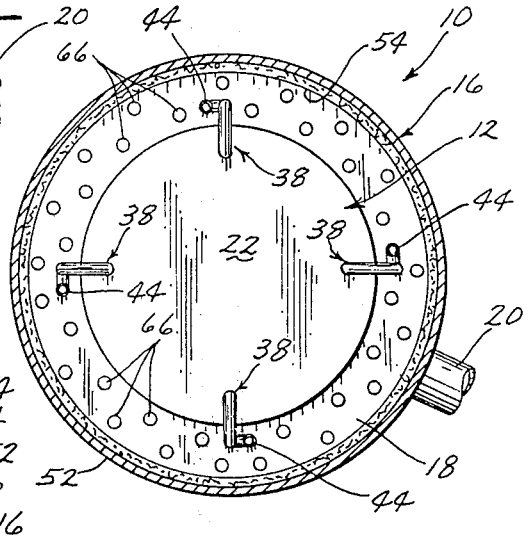
FIG. 2 is a top sectional view of the heat exchanger furnace as seen on line 2—2 in FIG. 1.

The heat exchanger furnace, indicated generally at 10 in FIG. 1, includes a heat exchanger housing 12 situated above a firebox 14 for receiving hot combustion gases from it. An insulated plenum housing 16 surrounds the heat exchanger housing and is spaced from it to define a plenum chamber 18 between them. Air introduced into the plenum chamber is warmed by the heat exchanger housing 12 and removed through a heat tube 20 for some useful heating purpose. The general arrangement, as thus far described, is well known in the art.

The heat exchanger housing 12 is shown as including a top wall 22 and an upright cylindrical sidewall 24 which is mounted on the firebox 14. A plurality of baffles are supported within the heat exchanger housing 12 in vertically spaced apart and generally horizontally extended relation therein. These include a lowermost circular baffle 26 having a generally V-shaped cross section and several upper circular flat plate baffles 28. The baffles include outer peripheral edges 30 and 32 respectively which are positioned in clearance relation from sidewall 24 so as to define an annular clearance opening 34. Accordingly, hot combustion gases rising through the heat exchanger housing 12, as indicated by arrows 36, are directed outwardly by the baffles against the sidewall 24 for increased conductive heat transfer to the sidewall.

Combustion gases are exhausted from the heat exchanger housing 12 through a plurality of exhaust tubes 38 which have one end in communication with an upper portion of the heat exchanger housing 12 as at 40 and an opposite end 42 which is directed externally of the plenum housing 16. Each exhaust tube 38 further comprises an intermediate U-shaped portion having a first leg 46 extended downwardly into the plenum chamber 18 and a second leg 44 extended upwardly and outwardly of the plenum chamber. The elongated length of the exhaust tubes 38 present additional heat transfer surfaces within the plenum chamber 18 for increased efficiency.

The plenum housing 16 includes a top wall 48, a bottom wall 50 and an upright cylindrical sidewall 52. Insulation material 54 lines the interior surface of at least top wall 48 and sidewall 52 to eliminate heat losses to the surrounding atmosphere.

Heat tube 20 communicates with an air outlet opening 56 through an upper portion of the plenum housing. Air is introduced through an air inlet opening 58 to which an air supply tube 60 is connected. An electric fan 62 is installed within the air supply tube 60 to provide forced air circulation into air inlet opening 58, through the plenum chamber and out the air outlet opening 56.

A baffle 64 is positioned within a lower portion of plenum chamber 18 upstream of fan 62. In the embodiment shown, the baffle 64 extends completely across the plenum chamber 18 and includes a plurality of openings 66. The baffle 64 is effective to produce a slightly higher pressure in the space 68 below the baffle than in the portion of the plenum chamber above the baffle, thereby ensuring even distribution of airflow at all circumferential positions about the plenum chamber 18. Further efficiency is achieved since the air within the plenum chamber 18 thus cools the heat exchanger housing 12 evenly.

Firebox 14 includes a bottom wall 70 supported in clearance relation from the bottom wall 50 of the plenum housing 16 by a support frame 72. The firebox further includes a frusto conical shaped sidewall 74 which flares upwardly and outwardly from bottom wall 70. Finally, a top wall 76 covers the firebox and has a central opening 78 for exhausting combustion gases to the heat exchanger housing 12.

The firebox is provided with separate air inlet and fuel inlet openings 80 and 82 respectively. Forced air is directed to the air inlet opening 80 through an air inlet passage 84 by a fan 86. Air inlet passage 84 has a reduced diameter end portion at 88 which creates slightly greater air pressure within the passage 84 than in the firebox 14.

Fuel such as grain is fed to the firebox through fuel inlet opening 82 by means of a fuel inlet passage 90 which may be provided with an electric powered auger 92, for example.

A relatively small diameter transfer tube 94 establishes communication between the air inlet passage 84 and fuel inlet passage 90 with the result that the increased air pressure at both the air and fuel inlet openings 80 and 82 prevents smoke and other combustion gases from escaping through the fuel inlet opening 82 to the stored fuel.

Combustion within the firebox 14 can be rather precisely adjusted by separately controlling the fan 86 and auger 92 which respectively supply air and fuel. Since the diameter of the firebox increases with its height, the surface area of the combustible material and thus the rate of combustion can be regulated by controlling the level of combustible material in the fuel box. The restricted opening 78 in top wall 76 cooperates with the forced air supply to produce sufficiently high temperatures within the combustion chamber for practically complete combustion of the fuel material leaving little if any ash or waste.

In operation, it is seen that the hot combustion gases from the firebox rise into the heat exchanger housing 12 and are directed outwardly by the baffles 26 and 28 for increased conductive heat transfer to the heat exchanger housing sidewall. Conductive heat transfer from the heat exchanger housing to air within the plenum chamber 18 is facilitated by the baffle 64 which assures substantially uniform airflow at all circumferential positions within the plenum chamber. The extension of the exhaust tubes downwardly into the plenum chamber provides increased heat transfer. For example, whereas air entering the exhaust tube 38 at 40 may be 250° F., the air exhausted at 42 will be about 175° F. The flared sidewalls of the firebox and separate control of the fuel and air supply enable a controlled burning which achieves complete combustion of the fuel material.

Whereas a preferred embodiment of the invention has been shown and described herein, it will be apparent that many modifications, alterations and variations may be made within the intended broad scope of the invention as defined in the appended claims. For example, whereas the cylindrical shape of the furnace is preferred, other embodiments may be constructed with a rectangular or irregular cross section.

Thus there has been shown and described an improved heat exchanger furnace.

We claim:

1. A heat exchanger furnace, comprising, a firebox including a bottom wall and an upwardly and outwardly flaring sidewall enclosure, an air inlet passage in communication at one end with said firebox, means for supplying air under pressure to said firebox through said air inlet passage, a fuel inlet opening in communication at one end with said firebox, means for supplying fuel to said firebox through said fuel inlet opening thereby to adjust the level of fuel in said firebox and a top wall adjacent said upper edge of said sidewall, said top wall having an outlet opening in communication with said heat exchanger housing for exhausting combustion gases thereto, and said sidewall enclosure having a frusto conical shape with a lower edge and an upper edge of larger diameter than said lower edge;

a heat exchanger housing in communication with said firebox for receiving combustion gases therefrom and being at least partially defined by at least one upright sidewall, and including a plurality of baffles therein, and means for supporting said baffles in vertically spaced-apart and generally horizontally extended relation therein, said baffles being continuous across said heat exchanger housing and terminating in peripheral edges disposed in clearance relation from said sidewall thereby to define a peripheral clearance opening therebetween;

a plenum housing surrounding said heat exchanger housing and spaced therefrom to define a plenum chamber therebetween;

means for separately controlling the rate of fuel and air supply to said firebox;

a fuel inlet passage in communication with said fuel inlet opening for conveying fuel thereto;

and a transfer tube in communication at one end with said air inlet passage and in communication at the other end with said fuel inlet passage whereby air introduced into said fuel inlet passage from said air inlet passage is operative to prevent the escape of combusion gases from said firebox through said fuel inlet passage, said air inlet passage having a reduced diameter portion adjacent said firebox and said transfer tube communicating with said air inlet passage upstream of said reduced diameter portion.

* * * * *